US009651217B2

(12) United States Patent
Greenwood et al.

(10) Patent No.: US 9,651,217 B2
(45) Date of Patent: May 16, 2017

(54) LENS ASSEMBLY

(71) Applicant: UTC FIRE & SECURITY AMERICAS CORPORATION, INC., Lincolnton, NC (US)

(72) Inventors: Thomas Greenwood, Terra Ceia, FL (US); Martin Paul Robotham, Bradenton, FL (US)

(73) Assignee: UTC FIRE & SECURITY AMERICAS CORPORATION, INC., Lincolnton, NC (US)

( * ) Notice: Subject to any disclaimer, the term of this patent is extended or adjusted under 35 U.S.C. 154(b) by 323 days.

(21) Appl. No.: 14/496,333

(22) Filed: Sep. 25, 2014

(65) Prior Publication Data

US 2015/0146435 A1 May 28, 2015

Related U.S. Application Data

(60) Provisional application No. 61/908,344, filed on Nov. 25, 2013.

(51) Int. Cl.

| | |
|---|---|
| ***F21V 5/00*** | (2015.01) |
| ***F21V 5/04*** | (2006.01) |
| ***F21V 7/00*** | (2006.01) |
| *F21Y 101/00* | (2016.01) |

(52) U.S. Cl.

CPC ..... *F21V 5/045* (2013.01); *F21V 7/0091* (2013.01); *F21Y 2101/00* (2013.01)

(58) Field of Classification Search

CPC . F21V 5/00; F21V 5/002; F21V 5/008; F21V 5/02; F21V 5/04; F21V 5/045; F21V 7/0091

USPC ..... 362/311.01–311.02, 311.06, 326–327, 362/332–340

See application file for complete search history.

(56) References Cited

U.S. PATENT DOCUMENTS

| | | | |
|---|---|---|---|
| 5,347,259 | A | 9/1994 | Jongewaard |
| 5,475,361 | A | 12/1995 | Curran et al. |
| 6,601,970 | B2 | 8/2003 | Ueda et al. |
| 7,006,003 | B2 | 2/2006 | Zimmerman et al. |
| 7,261,440 | B2 | 8/2007 | Kwasny |
| 7,832,908 | B2 | 11/2010 | Peck et al. |
| 7,850,345 | B2 | 12/2010 | Holder et al. |
| 7,918,596 | B2 | 4/2011 | Frank et al. |
| 7,959,326 | B2 | 6/2011 | Laporte |
| 8,197,110 | B2 | 6/2012 | Czajkowski |
| 8,348,475 | B2 | 1/2013 | Wilcox et al. |
| 8,465,170 | B2 | 6/2013 | Rong et al. |
| 2002/0085374 | A1 | 7/2002 | Anderson |
| 2005/0018147 | A1 | 1/2005 | Lee et al. |
| 2007/0153530 | A1 | 7/2007 | Czajkowski |

*Primary Examiner* — Jason Moon Han

(74) *Attorney, Agent, or Firm* — Cantor Colburn LLP

(57) ABSTRACT

A lens for forming a predetermined pattern from a light source includes a first region of an inner surface configured to receive light from the light source and to bend the light into a first line segment. The lens includes a second region of the inner surface configured to receive the light from the light source and to bend the light into a second line segment perpendicular to the first line segment, the first line segment forming a cross of a "T" and the second line segment forming the stem of the "T".

20 Claims, 12 Drawing Sheets

LENS ASSEMBLY

CROSS-REFERENCE TO RELATED APPLICATIONS

This application claims the benefit of U.S. provisional patent application Ser. No. 61/908,344, filed Nov. 25, 2013, the entire contents of which are incorporated herein by reference.

BACKGROUND

Embodiments of the invention relate to lenses and, in particular, to lenses that generate a predetermined light pattern from a light source that is a point of light or an approximate point of light.

Warning lights are used within buildings to notify occupants including the hearing impaired of emergencies, such as fires. Typically, the warning light includes a flashing bulb that is positioned within a reflector. Warning lights that are approved by Underwriters Laboratories (UL) must meet certain light-intensity requirements of horizontal and vertical planes of light. For example, the standard found at UL 1971 requires predetermined light intensities along a horizontal and vertical plane at 10 feet from the device. Conventional emergency notification systems utilize Xenon tubes, lenses, and reflectors to generate light in predetermined patterns.

BRIEF DESCRIPTION OF THE INVENTION

Embodiments of the present invention include a lens for forming a predetermined pattern from a light source. The lens includes a first region of an inner surface configured to receive light from the light source and to bend the light into a first line segment. The lens includes a second region of the inner surface configured to receive the light from the light source and to bend the light into a second line segment perpendicular to the first line segment, the first line segment forming a cross of a "T" and the second line segment forming the stem of the "T."

Embodiments of the present invention also include a lens assembly including a base board, a light source mounted to the base board, and a lens mounted to the base board and having an inner surface defining a cavity, such that the light source is located in the cavity. The inner surface of the lens has a first region configured to receive light from the light source and to bend the light to form a first line segment. The inner surface of the lens also has a second region configured to receive the light from the light source and to bend the light to form a second line segment perpendicular to the first line segment, such that the first line segment forms a cross of a "T" shape and the second line segment forms a stem of the "T" shape.

BRIEF DESCRIPTION OF THE DRAWINGS

The subject matter which is regarded as the invention is particularly pointed out and distinctly claimed in the claims at the conclusion of the specification. The foregoing and other features, and advantages of the invention are apparent from the following detailed description taken in conjunction with the accompanying drawings in which:

DETAILED DESCRIPTION OF THE INVENTION

Conventional emergency lighting systems utilize xenon strobes and reflectors to generate light patterns. However, conventional emergency lighting systems are inefficient, since Xenon strobes require relatively high size requirements and power requirements to generate the desired light patterns, resulting in a relatively low conversion efficacy, such as around 40 lm/W. Embodiments of the invention relate to lenses and lens assemblies that generate predetermined light patterns using a point-of-light source.

Figure 1:
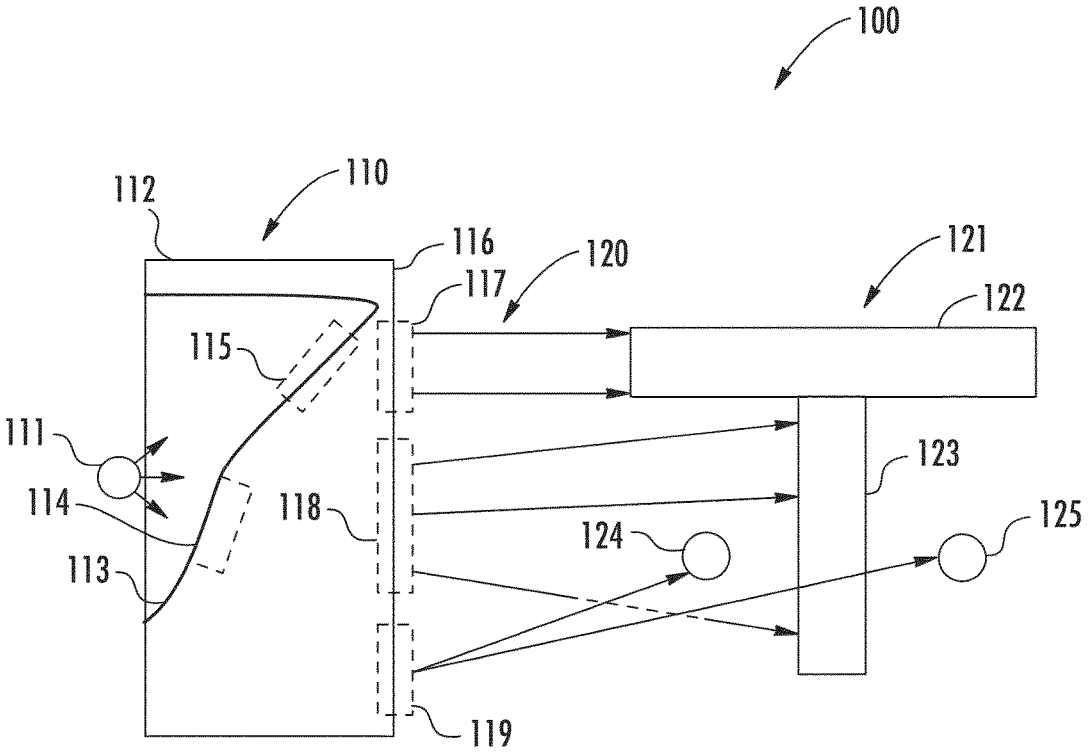
FIG. 1 is a block diagram of a lens assembly according to an embodiment of the invention.

FIG. 1 is a block diagram of a lens assembly 100 according to an embodiment of the invention. The assembly 100 includes a lens 110 that emits light 120 to form a shape 121. In particular, embodiments of the invention relate to a lens 110 configured to emit the light 120 to form a "T" shape having a first line segment 122 that forms the cross of the "T" and a second line segment 123 that forms the stem of the "T." In some embodiments, the lens 110 is further configured to emit light to form two spots 124 and 125 of light in the quadrants defined by the first line segment 122 and the second line segment 123.

The lens 110 includes a lens body 112 including an inner surface 113 and an outer surface 116. The inner surface 113 defines a cavity in which light is emitted from a light source 111. In embodiments of the invention, the light source 111 is a point-of-light source, or substantially a point-of-light source. In the present specification and claims, a point-of-light source is defined as a light source that emits light from a single point, which has a small size, such as 1 centimeters (cm) or less. In one embodiment, the light source 111 is a light emitting diode (LED). In such an embodiment, the light source 111 may be 0.5 cm or less. As defined in the present specification and claims, a point-of-light source is a substantially circular, spherical, semi-spherical, square, or other symmetrical geometric shape, in contrast to light sources provided by tubes, such as Xenon light bulbs. In one embodiment, the light source 111 emits light substantially isotropically. In another embodiment, the light source 111 emits light in a substantially hemispherical pattern. In yet another embodiment, the light source 111 emits light in a broad cone shape, such as an approximately 125 degree cone.

The inner surface 113 of the lens 110 includes a first region 115 and a second region 114. The first region 115 is shaped to collect light from the light source 111 and bend the light from the light source 111 such that, when emitted from the lens 110, the light travels along a substantially planar path to form the first line segment 122. The second region 114 is shaped to collect light from the light source 111 and bend the light from the light source 111 such that, when emitted from the lens 110, the light travels along a substantially planar path to form the second line segment 123. For purposes of description with reference to FIG. 1, the first region 115 bends light into a horizontal plane and the second region 114 bends light into a vertical plane. In other words, the first region 115 bends light into a plane perpendicular to the plane in which the second region 114 bends light from the light source 111. In some embodiments, the inner surface 113 further includes third and fourth regions (not shown in FIG. 1) that are shaped to bend the light from the light source 111 such that when the light is emitted from the lens 110, the light forms the dots 124 and 125.

The outer surface 116 of the lens 110 includes a fifth region 117, a sixth region 118, and may include a seventh region 119 and an eighth region (not shown in FIG. 1). The fifth region 117 is shaped to direct the light from the first region 114 of the inside surface 113 of the lens 110 out from the lens 110 to form the first line segment 122. In particular, the fifth region 117 redistributes the light from the first region 115 in an arc, around 180 degrees. In one embodiment, the fifth region 117 redistributes the light in the arc to correspond to the requirements of the UL-1971 light output requirements.

The sixth region 118 is shaped to direct the light from the second region 114 of the inside surface 113 of the lens 110 out from the lens 110 to form the second line segment 123. In particular, the sixth region 118 redistributes the light from the second region 114 in an arc, around 90 degrees. In one embodiment, the sixth region 118 redistributes the light in the arc to correspond to the requirements of the UL-1971 light output requirements. The seventh region 119 and the eighth region (not shown in FIG. 1) are shaped to direct the light from third and fourth regions (not shown in FIG. 1) of the inside surface 113 out from the lens 110 to form the dots 124 and 125.

In one embodiment of the invention, the lens 110 does not use reflectors to form the shape 121. Instead, the light from the light source 111 is bent to form the shape 121 only by the refraction formations of the lens 110. In such an embodiment, the light source 111 is located inside a cavity of the lens 110, and the light passes through the lens 110 and is bent by the lens 110 to form the predetermined light pattern or shape 121. In addition the lens 110 may utilize internal reflection, rather than including a coating or reflecting device applied to the lens 110.

It is understood that FIG. 1 is provided only to provide a general description of one embodiment of the invention, and the objects and features illustrated in FIG. 1 may not necessarily be depicted to-scale. The embodiments that follow describe features and structures of the lens assembly 100 in further detail, by way of example. However, embodiments of the invention encompass any lens that bends the light from a point-of-light source to from a "T"-shaped light pattern at a predetermined intensity.

Figure 2:
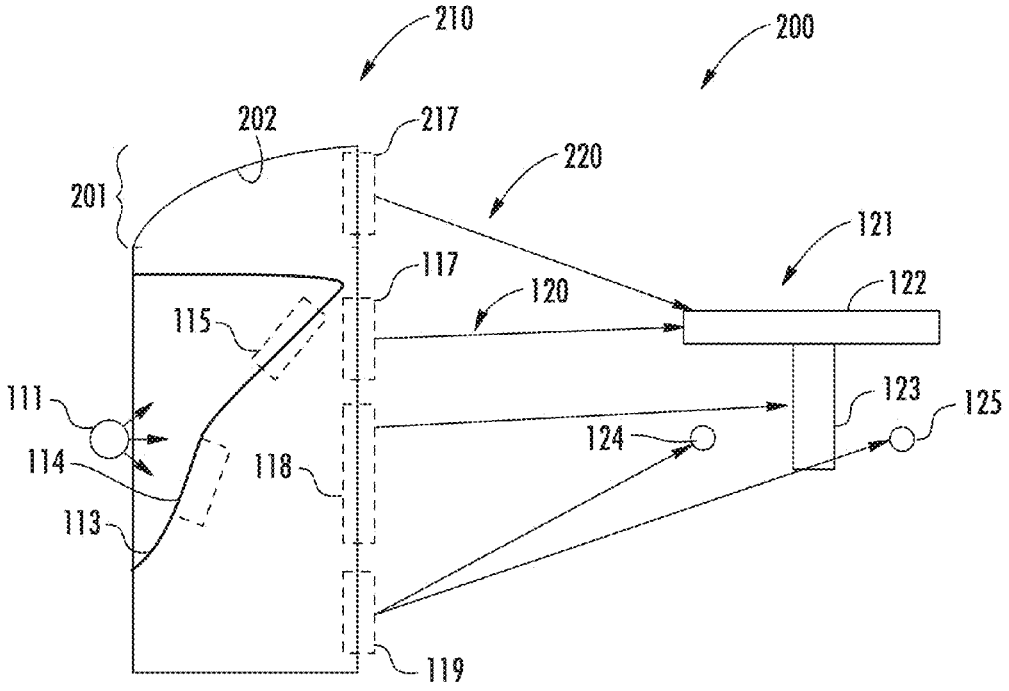
FIG. 2 is a block diagram of a lens assembly according to another embodiment of the invention.

FIG. 2 illustrates a lens assembly 200 according to another embodiment. The lens assembly 200 of FIG. 2 is similar to the lens assembly 100 of FIG. 1, except the lens assembly 200 includes a reflective portion 201. The reflective portion 201 includes an inner reflective surface 202. In one embodiment, the reflective surface 202 reflects light from the light source 111, and in particular light from the light source 111 that is directed upward from the light source, based on the shape of the reflective surface 202. In one embodiment, the reflective surface 202 does not include any reflective coating to cause the surface 202 to reflect light.

Light reflected by the reflective surface 202 is transmitted through the lens 210 and emitted from the lens 210 via a ninth region 217. The ninth region 217 is shaped to direct the light from the reflective surface 202 of the lens 210 out from the lens 210 to form the first line segment 122. In particular, the ninth region 217 redistributes the light from reflective surface 202 in an arc, around 180 degrees. In one embodiment, the ninth region 202 redistributes the light in the arc to correspond to the requirements of the UL-1971 light output requirements. It is understood that while FIG. 2 illustrates light 220 being emitted from the lens 210 at an angle, the "T" shape 121 is not drawn to scale, and the light 220 may travel along a substantially horizontal plane to form the cross of the "T" pattern 121. In some embodiments, the substantially horizontal plane includes a variance of a number of degrees within a predetermined tolerance level to form the "T" having a predetermined shape and brightness. In one embodiment, the substantially horizontal plane includes light travelling within +/−15 degrees of the horizontal plane.

Figure 3A:
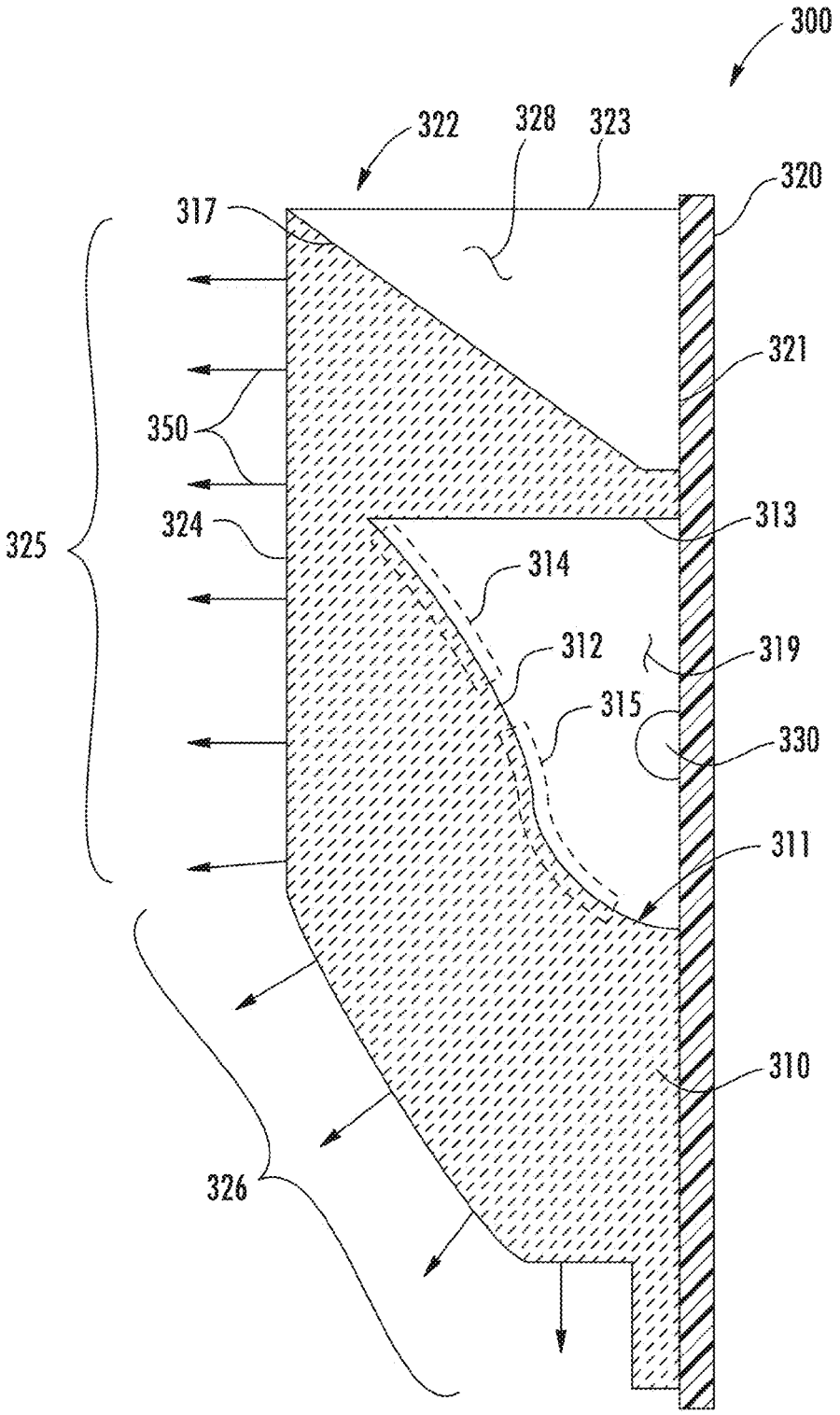
FIG. 3A is a side cross-section view of a lens assembly according to an embodiment of the invention.

FIG. 3A is a side cross-section view of a lens assembly 300 according to an embodiment of the invention. While the description of FIGS. 3A to 3D are provided by referring to a "top," "front," and "rear," these terms are provided only by reference to the figures, and it is understood that embodiments of the invention encompass lenses and lens assemblies having any orientation. The lens assembly 300 includes a lens body 310. A point-of-light source 330 is mounted to a base 320, which is attached to the lens body 310. In one embodiment, the base 320 is attached to a rear surface 321 of the lens body 310. The point-of-light source 330 is located within the main cavity 319 formed by the inner surface 311 of the lens body 310. In one embodiment, the base 320 is a printed wiring board including electrical connections to provide power to the point-of-light source 330. However, embodiments of the invention encompass any type of base 320 capable of being mounted to the lens body 310 or having the lens body 310 mounted to the base 320. In addition, while the light source is described as a point-of-light source 330, it is understood that the point-of-light source may be an approximation of a point-of-light, such as a light-emitting diode (LED) or other light source that emits light isotropically from a light generating region, or substantially isotropically. Embodiments further include light generated hemispherically or substantially hemispherically from a light source into the lens 310.

The lens body 310 includes an inner surface 311. The cross-section illustrated in FIG. 3A illustrates a front inner surface 312 and a top inner surface 313, which together form a substantially half-bell shape. The front inner surface 312 includes a first inner surface region 314, a second inner surface region 315, and a third inner surface region 316, illustrated in FIG. 3C. The first inner surface region 314 is shaped to bend light 350 from the light source 330 such that when the light 350 exits the lens body 310, the light 350 is traveling along a first plane to form a cross of a "T." The second inner surface region 315 is shaped to bend light 350 from the light source 330 such that when the light 350 exits the lens body 310, the light 350 is traveling along a second plane to form the stem of the "T." The third inner surface region 316, as illustrated in FIG. 3C, is shaped to bend light 350 from the light source 330 such that when the light 350 exits the lens body 310, the light 350 forms dots of light in quadrants formed by the first plane and the second plane.

The lens body 310 is further defined by an outer surface 322 including a top outer surface 323 and a front outer surface 324. The lens body 310 further includes a reflective surface 317 that is angled such that light 350 transmitted through the top inner surface 313 into the lens body 310 from the light source 330 is reflected out the front surface 324 of the lens body 310 along the first plane to form the cross of the "T." In one embodiment, the reflective surface 317 reflects the light only by the angle of the reflective surface 317 without the addition of any reflective coating, layer, or material. In another embodiment, a reflective coating, layer, or material may be located on the outside of the reflective surface 317 to increase reflection of the light 350. In one embodiment, the reflective surface 317 forms the base of a cavity 328 having a top defined by the top outer surface 323. In another embodiment, the top outer surface 323 may be the same as the reflective surface 317, resulting in no cavity 328.

The front outer surface 324 includes a first outer surface region 325 and a second outer surface region 326. In one embodiment, the first outer surface region 325 is shaped to redistribute light from the reflective surface 317 and the first inner surface region 314 along the first plane to form the cross of the "T" light pattern having predetermined light intensities. Likewise, in one embodiment, the second outer surface region 326 is shaped to redistribute light from the second inner surface region 315 along the second plane to form the stem of the "T" light pattern having predetermined light intensities.

In one embodiment, the first outer surface region 325 redistributes the light from reflective surface 317 and the first inner surface region 314 in an arc, around 180 degrees. In one embodiment, the first outer surface region 325 redistributes the light in the arc to correspond to the requirements of the UL-1971 light output requirements. In some embodiments, the light traveling along the first plane includes a variance of a number of degrees within a predetermined tolerance level to form the "T" having a predetermined shape and brightness. In one embodiment, the first plane includes light traveling within around +/−15 degrees of the first plane In one embodiment, the second outer surface region 326 redistributes the light from the second inner surface region 315 in an arc, around 90 degrees. In one embodiment, the second outer surface region 326 redistributes the light in the arc to correspond to the requirements of the UL-1971 light output requirements.

In one embodiment, the first and second inner surface regions 314 and 315 are smooth surfaces, which do not include angular protrusions. In another embodiment, the first and second inner surface regions 314 and 315 include one or more angular protrusions, such as Fresnel lens features. In one embodiment, the first and second inner surface regions 314 and 315 form a cross-sectional shape similar to a half-bell shape, as illustrated in FIG. 3A, which corresponds to a cross-section formed by the second plane formed by the light 350 that forms the stem of the "T." In other words, as the light 350 that passes through the second inner surface region 315 exits the lens body 310, the light 350 travels substantially along the second plane to form the stem of the "T," and FIG. 3A represents a cross-section formed by the second plane.

In one embodiment, the first inner surface region 314 has a substantially convex shape as viewed from the cross-section formed by the second plane, and the second inner surface region 315 has a substantially concave shape as viewed from the cross-section formed by the second plane.

Figure 3B:
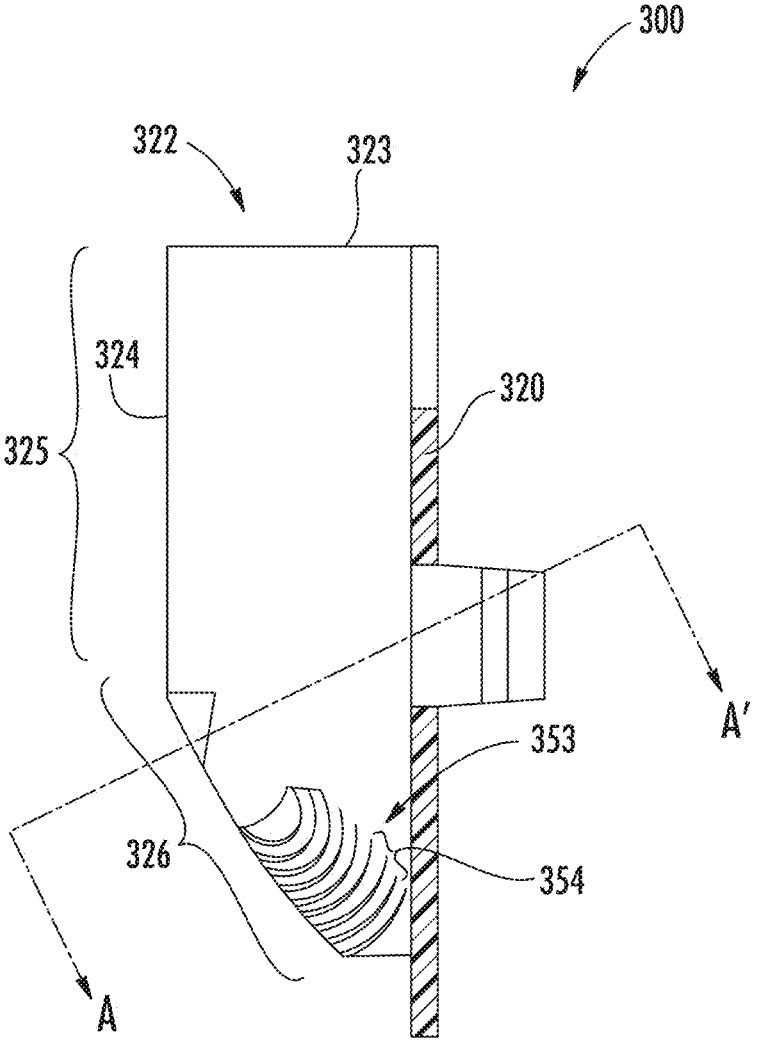
FIG. 3B is a side view of the lens assembly according to an embodiment of the invention.
Figure 3C:
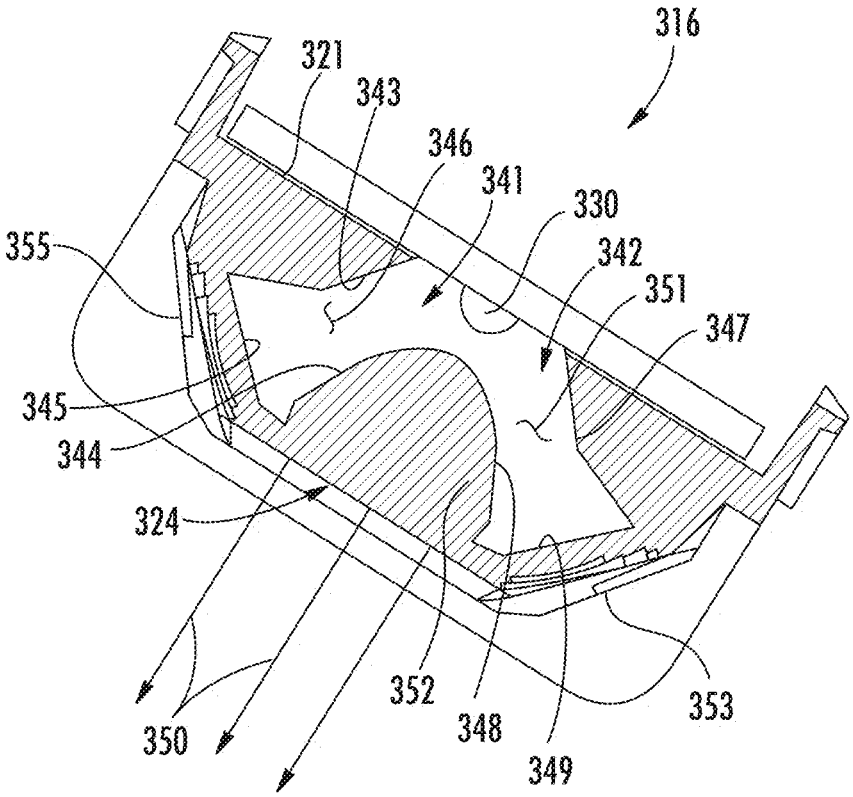
FIG. 3C is a cross-sectional view of the lens assembly according to an embodiment of the invention.

FIG. 3B illustrates a side view of the outer surface 322 of the lens assembly 300. FIG. 3C is a cross-section of the lens body 310 taken along the line A-A' of FIG. 3B to illustrate the third inner surface region 316. Referring to FIG. 3C, the third inner surface region 316 includes a first sub-region 341 and a second sub-region 342. The first sub-region 341 is defined by a first side wall 343, a second side wall 344, and a first base wall 345 defining a first cavity 346. The second sub-region 342 is defined by a third side wall 347, a fourth side wall 348, and a second base wall 349 defining a second cavity 351. The second and fourth side walls 344 and 348 are part of a protrusion 352 of the lens body 310 having a convex shape along the plane defined by the line A-A' of FIG. 3B.

Light 350 transmitted from the light source 330 travels through the cavities 346 and 351, and is directed by the shape of the first, second, third, and fourth side walls 343, 344, 347, and 348, and by the first and second base walls 345 and 249 to form light patterns of dots in quadrants formed by the first and second planes. The outer surface 322 of the lens body 310 includes a third outer surface region 353 corresponding to the second sub-region 342 and a fourth outer surface region 355 corresponding to the first sub-region 341. The third outer surface region 353 and the fourth outer surface region 355 are shaped to redistribute the light 350 from the lens body 310 corresponding to the first and second sub-regions 341 and 342 into light patterns to form dots having predetermined light intensity patterns. In one embodiment, the third outer surface region 353 and the fourth outer surface region 355 include Fresnel lens features 354, as illustrated in FIG. 3B. In one embodiment, the Fresnel lens features are concentrically-stepped circular shapes, semi-circular shapes, or arc shapes.

Figure 3D:
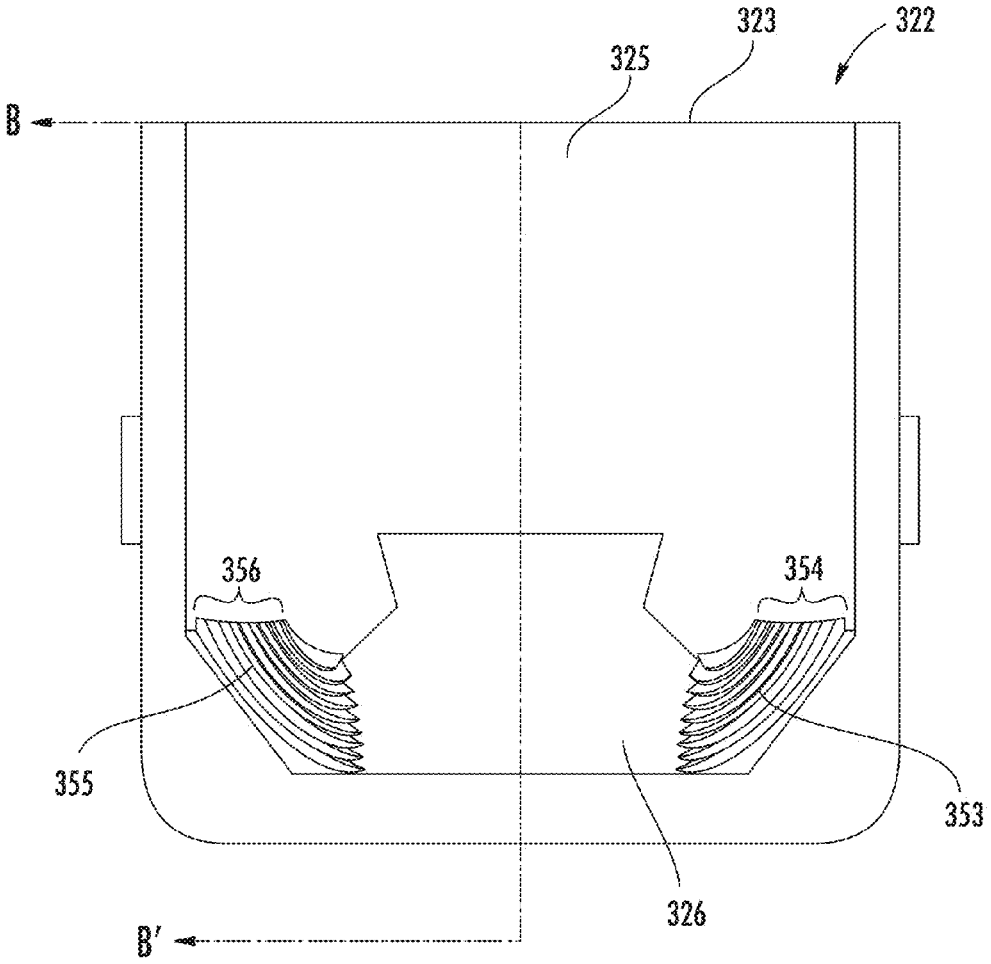
FIG. 3D is a front view of the lens assembly according to an embodiment of the invention.

FIG. 3D illustrates a front view of the outer surface 322 of the lens body 310. FIG. 3A is a cross-section as taken along the line B-B' of FIG. 3D. In one embodiment, the first outer surface region 325 is a substantially cylindrical shape, such as a semi-cylindrical shape or half-cylindrical shape. In one embodiment, the second outer surface region 326 is curved or angled with respect to the first outer surface region 325. As illustrated in FIG. 3D, the third outer surface region 353 may include Fresnel lens features 354, and the fourth outer surface region 355 may include Fresnel lens features 356.

Figure 3E:
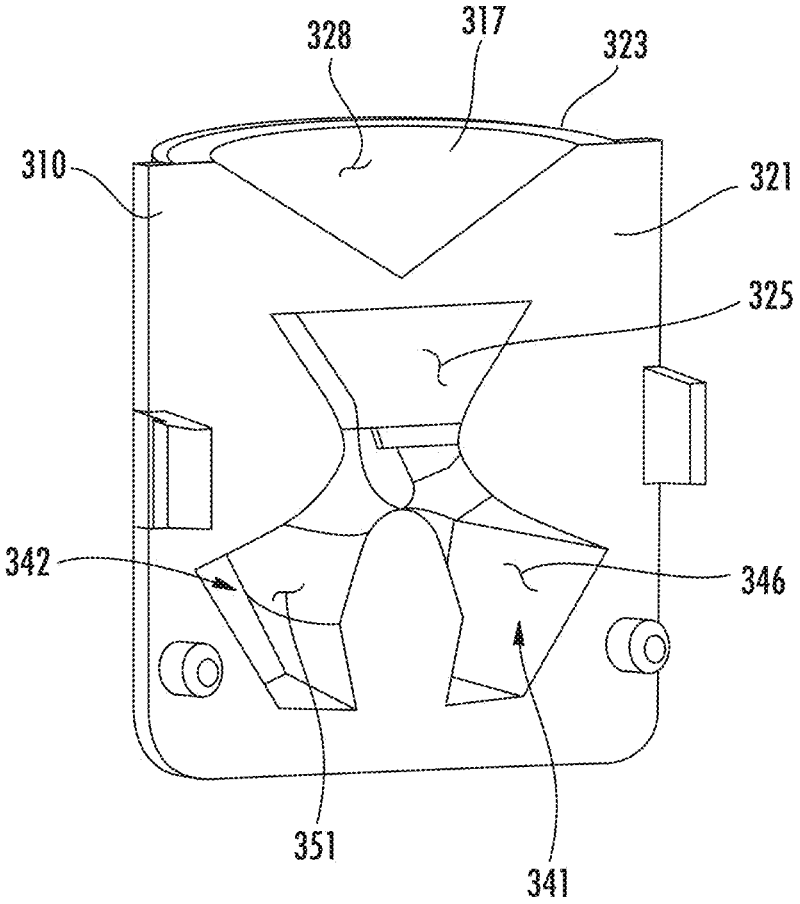
FIG. 3E is a rear view of the lens assembly according to an embodiment of the invention.

FIG. 3E is a rear view of the lens body 310. As illustrated in FIG. 3E, the inner surface 311 (shown in FIG. 3A) of the lens body 310 defines the main cavity 319 (shown in FIG. 3A), the first cavity 346 of the first sub-region 341 and the second cavity 351 of the second sub-region 342. In addition, the reflective surface 317 defines the cavity 328 or recess in the top outer surface 323 of the lens body 310. As illustrated in FIG. 3E, in one embodiment, the reflective surface 317 is a cone or semi-cone shape.

Figure 4:
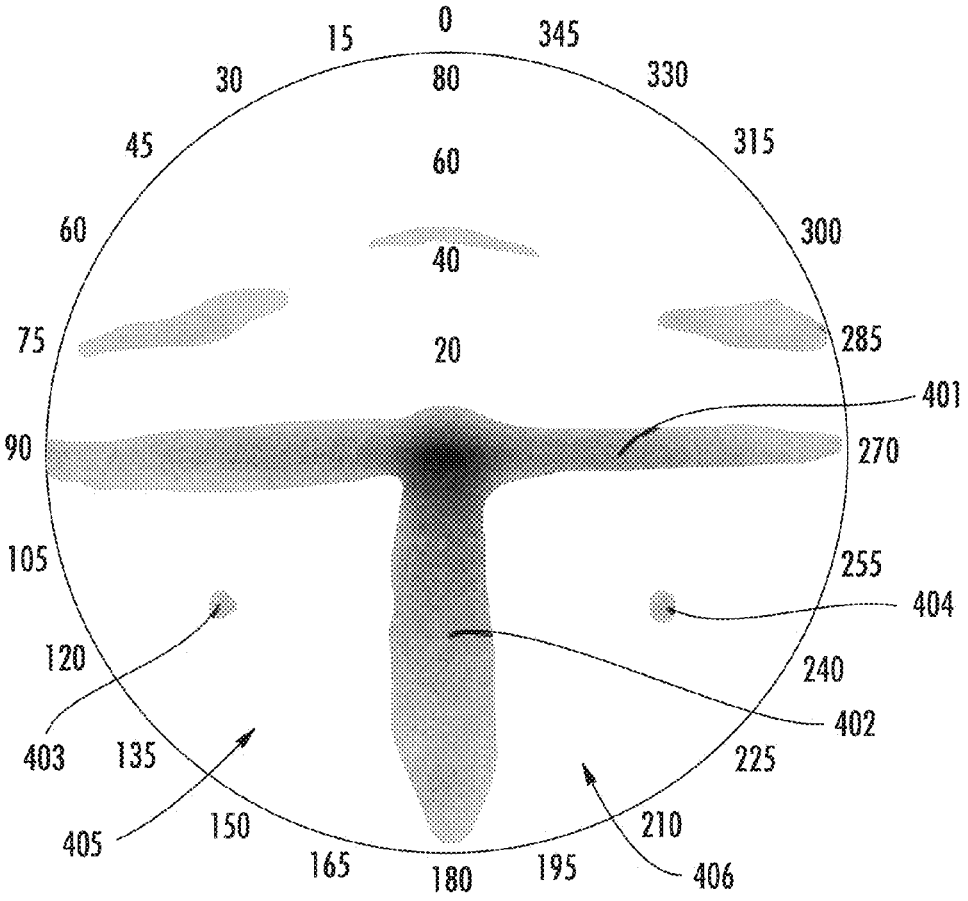
FIG. 4 is a light pattern generated by the lens assembly according to an embodiment of the invention.

FIG. 4 illustrates an example of a light pattern formed by the lens 310 of FIGS. 3A to 3E. As illustrated in FIG. 4, the light is directed into a substantially "T" shaped pattern, with a cross 401 of the "T" located along the 90 degree-270 degree axis, and the stem 402 of the "T" located along the 180 degree axis. The dots 403 and 404 are located within the quadrants 405 and 406 formed by the cross 401 and the stem 402 of the "T." In addition, as illustrated in FIG. 4, a majority of the light that forms the "T" is within an approximately 30 degree range (or +/−15 degrees) of the respective axes. For example, the light that forms the stem 302 is within +/−15 degrees of the 180 degree axis.

Figure 5A:
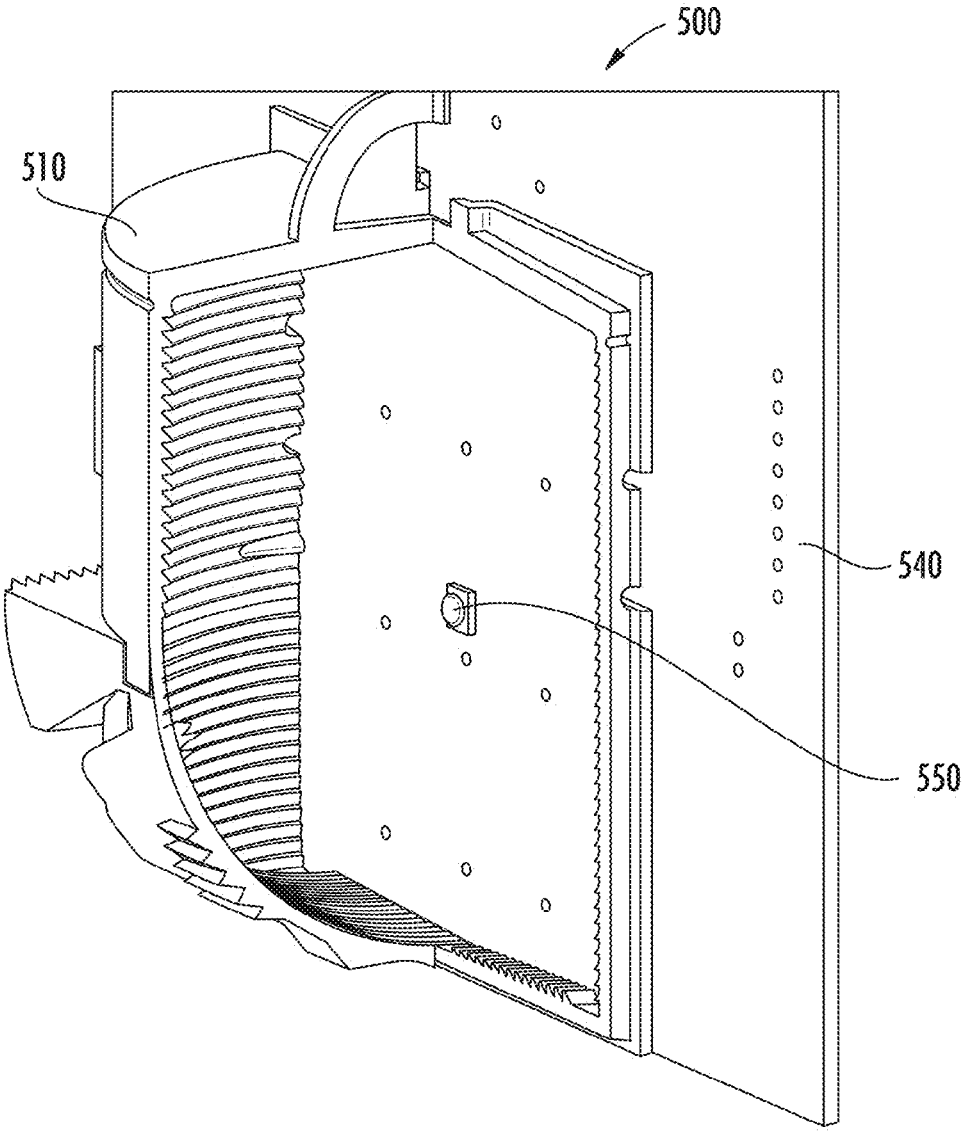
FIG. 5A is a side cross-section view of a lens assembly according to another embodiment of the invention.
Figure 5B:
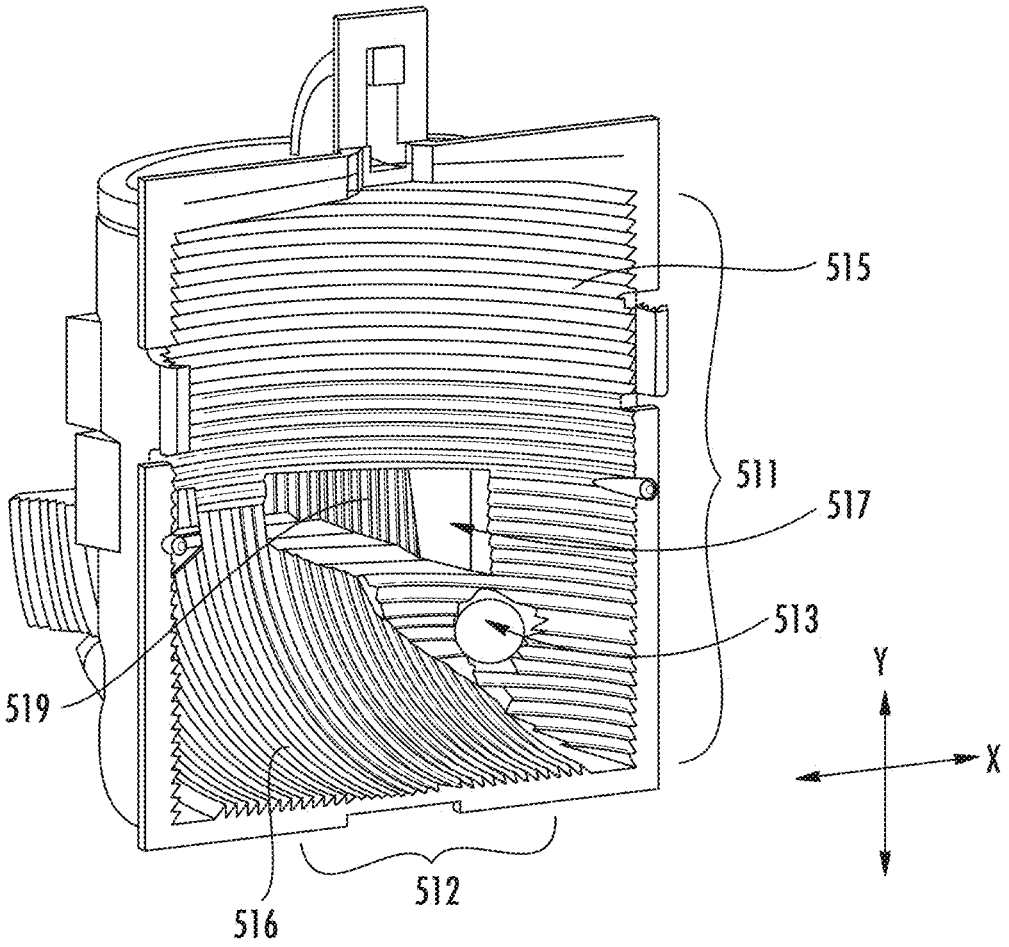
FIG. 5B is a rear view of the lens assembly according to one embodiment.
Figure 5C:
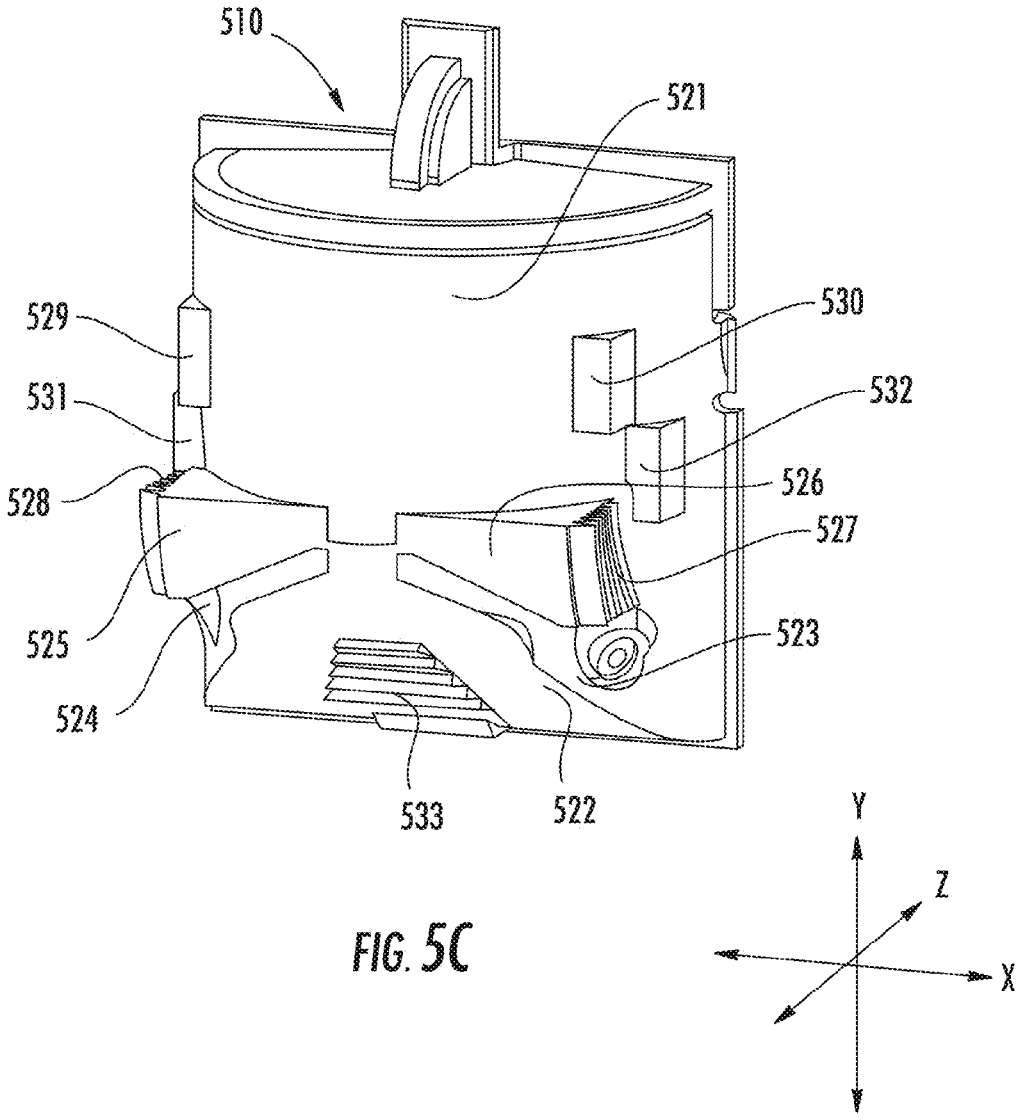
FIG. 5C is a front view of the lens assembly according to one embodiment.

FIGS. 5A to 5C illustrate a lens assembly 500 according to another embodiment of the invention. Referring to FIG. 5A, the lens assembly 500 includes a lens 510, base 540 and point-of-light source 550. The light source 550 may be mounted to the base 540, such that when the lens 510 is attached to the base 540, the light source 550 is located in a cavity defined by the inner surfaces of the lens 510. In one embodiment, the light source 550 is an LED. However, embodiments of the invention encompass any light source that originates from substantially a single point of light, such as a point of light within a diameter of 1 cm or less.

FIG. 5B shows an inside surface of the lens 510 according to one embodiment of the invention. The lens 510 includes a first region 511, a second region 512, and a third region 513. The first region 511 includes lens features 515 that are configured to bend light from the light source 550 such that when the light is emitted from the lens 510, the light is traveling along a first plane to form a cross of a "T." In one embodiment, the lens features 515 are Fresnel lens features, or closely-spaced ridges in the lens 510 that are configured to bend the light in a particular direction. For example, Fresnel lens features that are configured to bend the light to form the cross of the "T" are substantially parallel to the cross of the "T." The second region 512 similarly includes lens features 516 that are shaped to bend light from the light source 550 such that when the light exits the lens 510, the light is traveling along a second plane to form the stem of the "T." In FIG. 5B, the lens features 516 are Fresnel lens features that are parallel to the stem of the "T."

The third region 513 is shaped to bend light from the light source 550 such that when the light exits the lens 510, the light forms a dot of light in a quadrant formed by the first plane and the second plane. The inner surface of the lens 510 may also include a fourth region, which is not shown in FIG. 5B, which is similar to the third region 513, and is located on an opposite side of the second region 512 from the third region 513.

In one embodiment, the first region 511 has a substantially cylindrical shape, such as a semi-cylindrical shape or a half-cylindrical shape. A center axis of the cylinder may be parallel to the axis Y which defines the height of the lens 510 in FIG. 5B, although it is understood that embodiments of the invention encompass any orientation of the lens 510. The second region 512 is curved with respect to the first region 511. For example, the second region 512 may be curved around the X axis, which is a side-to-side axis perpendicular to the Y axis in FIG. 5B.

The lens 510 may include one or more additional focusing regions 517 recessed into the first region 511. The focusing region 517 includes lens features 519, which are Fresnel lens features in FIG. 5B, which further bend the light to direct the light onto the second plane to form the stem of the "T."

FIG. 5C illustrates an outer surface of the lens 510. The outer surface of the lens 510 includes a fifth region 521, a sixth region 522, a seventh region 523, and an eighth region 524. In one embodiment, the fifth through eighth regions 521 through 524 do not include features to bend light from the lens 520. Instead, these regions may be shaped only to pass light from inside the lens 520 out of the lens 520 without redirecting the light.

In one embodiment, the fifth region 521 is a substantially cylindrical shape, such as a semi-cylindrical shape or half-cylindrical shape. A center axis of the cylinder may be parallel to the axis Y which extends in a direction from a bottom of the lens 510 to the top of the lens 510 in FIG. 5C. In one embodiment, the outer surface of the lens 510 is smooth in the fifth region 521, in contrast to the inner surface of the lens 510 in the first region 511, which has lens features 515. In one embodiment, the sixth region 522 is curved or angled with respect to the fifth region 521. In addition, the seventh and eighth regions 523 and 524 may be protrusions that protrude outward from the sixth region 522 in one or both of the direction X and the direction Y.

In one embodiment of the invention, the outer surface of the lens 510 further includes lens features 529, 530, 531 and 532 which are protrusions that extend outward from the fifth region 521 to direct light along a plane parallel to the first plane and located outward from the second plane. In one embodiment of the invention, the outer surface of the lens 510 further includes lens features 527 and 528, which are Fresnel lenses in FIG. 5C located on the protrusions 525 and 526. The lens features 527 and 528 may direct the light outward to the ends of the "T" on each side of the lens 510. In particular, the lens features 527 and 528 may focus light such as around +/−90 degrees toward the X axis from the depth axis Z illustrated in FIG. 5C.

In addition, in one embodiment of the invention, the outer surface of the lens 510 includes lens features 533 in the sixth region 522 to direct light exiting the lens 510 in a downward direction, such as −90 degrees toward the Y axis from the Z axis, as illustrated in FIG. 5C. In particular, the lens features 533 may be configured to redistribute light intensity of light along the second plane.

Figure 6:
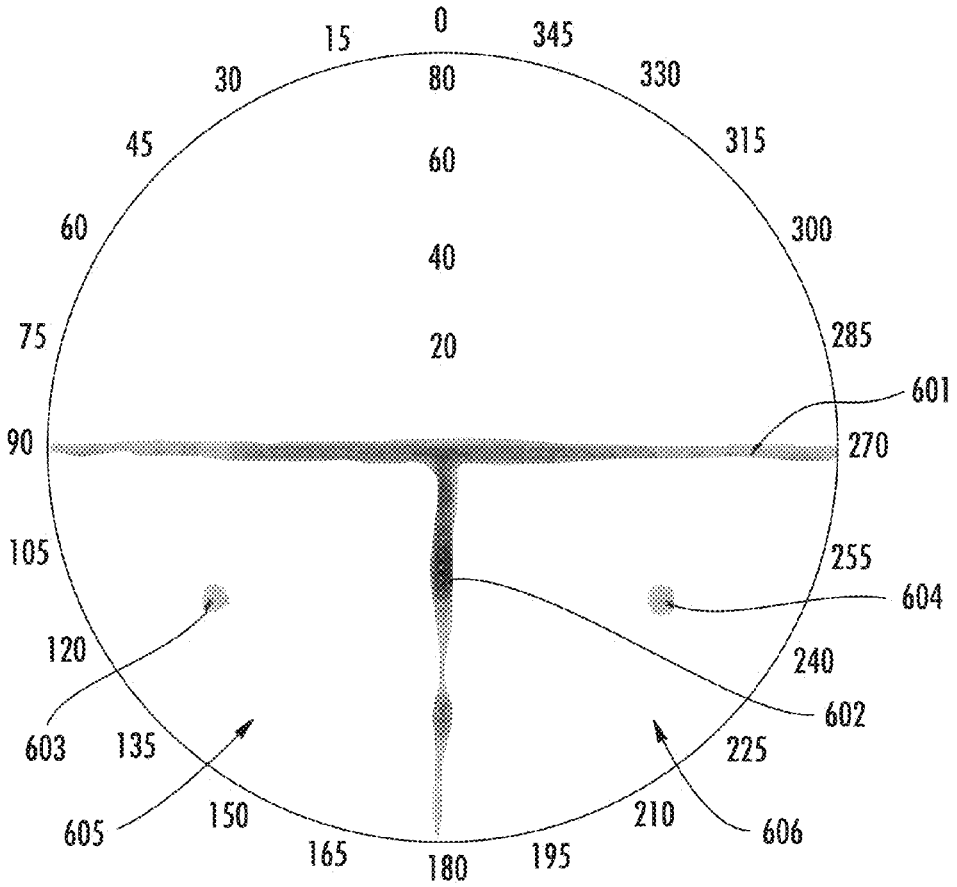
FIG. 6 is a light pattern generated by the lens assembly according to an embodiment of the invention.

FIG. 6 illustrates an example of a light pattern formed by the lens 510 of FIGS. 5A to 5C. As illustrated in FIG. 6, the light is directed into a substantially "T" shaped pattern, with a cross 601 of the "T" located along the 90 degree-270 degree axis, and the stem 602 of the "T" located along the 180 degree axis. The dots 603 and 604 are located within the quadrants 605 and 606 formed by the cross 601 and the stem 602 of the "T." In addition, as illustrated in FIG. 6, a majority of the light that forms the "T" is within an approximately 3 degree range (or +/−1 degrees) of the respective axes. For example, the light that forms the stem 602 is within +/−1 degrees of the 180 degree axis.

As illustrated in FIGS. 3A to 6, embodiments of the invention encompass lenses having different features to form a "T" shaped light pattern from a point-of-light source. The lens body 310 of the embodiment illustrated in FIGS. 3A-3E provides a "T" pattern having a less precise light intensity (e.g. within about +/−15 degrees of the cross and stem of the "T" respectively), and the lens 410 of the embodiment illustrated in FIGS. 5A-5C provides a "T" pattern having a more precise light intensity (e.g. within about +/−1 degree of the cross and stem of the "T", respectively). In other words, the lens 510 of FIGS. 5A-5C has a higher efficacy than the lens body 310 of FIGS. 3A to 3E. However, the lens body 310 has a more compact shape and takes up less area than the lens 510. The compact lens body 310 has an inner surface that folds light into two perpendicular planes. The outer surface then re-distributes the light within these planes to meet predetermined requirements, such as UL 1971 requirements. In contrast, the high-efficiency lens 510 uses the large areas of the inner surface to bring the light into two planes, then other inner surface features to boost the light in certain areas of the "T." There are also a few outer surface features to help normalize the light distribution. However, this is in contrast to the lens 310 in which the whole outer surface is used to redistribute light. Accordingly, these lenses are provided by way of example to illustrate that different lens features may be utilized to provide increased efficiency and increased compactness. Embodiments of the invention are not limited to those illustrated, but include any combinations of the above-described features and other lens features that bend light from a point-of-light source to form a substantially "T"-shaped light pattern.

In one embodiment of the invention, the lens or lens assembly is configured to form a "T" shaped light pattern that satisfies the UL 1971 test standards for lighting devices. In particular, the lens or lens assembly may be configured to receive light from a point-of-light source, such as an LED, and distribute the light in an area having a polar distribution while maintaining an intensity of at least 15 candelas (cd), of 110 cd, or of 177 cd. In some embodiments of the invention, the lens does not include reflectors to reflect the light from the light source.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

The invention claimed is:

1. A lens for forming a predetermined pattern from a light source, comprising:

a first region of an inner surface configured to receive light from the light source and to bend the light into a first line segment; and a second region of the inner surface configured to receive the light from the light source and to bend the light into a second line segment perpendicular to the first line segment, the first line segment forming a cross of a "T" and the second line segment forming a stem of the "T", whereby the first line segment and the second line segment form a total output of the light from the light source.

2. The lens of claim 1, further comprising:

an outer surface including a first region and a second region, wherein the first region of the outer surface is configured to accept light from the first region of the inner surface and redistribute the light from the first region of the inner surface along the first line segment to maintain predetermined light intensities at predetermined locations along the first line segment, and the second region of the outer surface is configured to accept light from the second region of the inner surface and redistribute the light from the second region of the inner surface along the second line segment to maintain predetermined light intensities at predetermined locations along the second line segment.

3. The lens of claim 1, wherein the second region of the inner surface is configured to form the second line segment by bending light to travel substantially along a first plane upon leaving the lens, the first region of the inner surface is a convex cross-sectional shape as viewed from a cross-section formed by the first plane, and the second region of the inner surface is a concave cross-sectional shape as viewed from the cross-section formed by the first plane.

4. The lens of claim 1, wherein the first region of the inner surface is configured to form the first line segment by bending light to travel substantially along a second plane upon leaving the lens, and the second region of the inner surface is a convex cross-sectional shape as viewed from a cross-section formed by the second plane.

5. The lens of claim 1, further comprising:

a third region of the inner surface recessed in the inner surface; and a fourth region of the inner surface recessed in the inner surface, the third region configured to bend the light to form a first dot of light in a first quadrant formed by the first line segment and the second line segment, and the fourth region configured to bend the light to form a second dot of light in a second quadrant formed by the first line segment and the second line segment, the second quadrant located on an opposite side of the second line segment from the first quadrant.

6. The lens of claim 5, wherein the third region and the fourth region include circularly-shaped Fresnel lenses.

7. The lens of claim 1, further comprising:

a fifth region of an outer surface configured to receive light from within the lens and to bend the light to redistribute the light along the first line segment; and a sixth region of the outer surface configured to receive the light from within the lens and to bend the light to redistribute the light along the second line segment.

8. The lens of claim 7, further comprising:

a seventh region protruding from the sixth region of the outer surface and an eighth region protruding from the sixth region of the outer surface, the seventh and eighth regions configured to receive light from within the lens and to form the first and second dots of light.

9. The lens of claim 1, wherein the first region comprises a plurality of Fresnel lenses substantially parallel to the first line segment, and the second region comprises a plurality of Fresnel lenses substantially parallel to the second line segment.

10. The lens of claim 9, wherein the first region comprises a substantially semi-cylindrical shape.

11. The lens of claim 9, wherein an outer surface of the lens opposite the second region includes a plurality of Fresnel lenses arranged parallel to the first line segment.

12. The lens of claim 1, further comprising:

a reflective surface located on an opposite side of the first region from the second region, the reflective surface configured to reflect light onto the first line segment based on an angle of the reflective surface.

13. A lens assembly, comprising:

a base board;

a light source mounted to the base board; and a lens mounted to the base board and having an inner surface defining a cavity, such that the light source is located in the cavity, the inner surface of the lens having a first region configured to receive light from the light source and to bend the light to form a first line segment, and the inner surface of the lens having a second region configured to receive the light from the light source and to bend the light to form a second line segment perpendicular to the first line segment, such that the first line segment forms a cross of a "T" shape and the second line segment forms a stem of the "T" shape, whereby the first line segment and the second line segment form a total output of the light from the light source.

14. The lens assembly of claim 13, wherein the light source is a light-emitting diode.

15. The lens assembly of claim 13, wherein the second region is configured to form the second line segment by bending light to travel substantially along a first plane upon leaving the lens, the first region is a convex cross-sectional shape as viewed from a cross-section formed by the first plane, and the second region is a concave cross-sectional shape as viewed from the cross-section formed by the first plane.

16. The lens assembly of claim 13, wherein the first region is configured to form the first line segment by bending light to travel substantially along a second plane upon leaving the lens, and the second region of the inner surface is a convex cross-sectional shape as viewed from a cross-section formed by the second plane.

17. The lens assembly of claim 13, wherein the inner surface of the lens further comprises:

a third region comprising a first recess in the inner surface; and a fourth region comprising a second recess in the inner surface, the third region configured to bend the light to form a first dot of light in a first quadrant formed by the first line segment and the second line segment, and the fourth region configured to bend the light to form a second dot of light in a second quadrant formed by the first line segment and the second line segment, the second quadrant located on an opposite side of the second line segment from the first quadrant.

18. The lens assembly of claim 17, wherein the third region and the fourth region include circularly-shaped Fresnel lenses.

19. The lens assembly of claim 13, wherein the first region of the inner surface of the lens comprises a plurality of Fresnel lenses substantially parallel to the first line segment, and the second region of the inner surface of the lens comprises a plurality of Fresnel lenses substantially parallel to the second line segment.

20. The lens assembly of claim 19, wherein the first region of the inner surface of the lens comprises a substantially semi-cylindrical shape.

* * * * *